United States Patent [19]

Walker

[11] Patent Number: 4,913,442

[45] Date of Patent: Apr. 3, 1990

[54] HORIZONTALLY-RESILIENT GOLF TEE MAT

[76] Inventor: Grant W. Walker, 4339 Lantzy Ct., Sacramento, Calif. 95825

[21] Appl. No.: 355,199

[22] Filed: May 22, 1989

[51] Int. Cl.[4] ..... A63B 69/36

[52] U.S. Cl. ..... 273/195 A; 273/DIG. 13

[58] Field of Search ..... 273/195 R, 195 A, 183 A, 273/DIG. 13, 176 J

[56] References Cited

U.S. PATENT DOCUMENTS

| | | | |
|---|---|---|---|
| 3,712,628 | 1/1973 | Boss, Jr. | 273/195 A |
| 4,130,283 | 12/1978 | Lindquist | 273/195 A |
| 4,311,312 | 1/1982 | O'Brien | 273/195 A |
| 4,387,896 | 6/1983 | O'Brien | 273/195 A |
| 4,596,392 | 6/1986 | Walker | 273/183 C |
| 4,844,470 | 7/1989 | Hammon et al. | 273/195 A |

*Primary Examiner*—George J. Marlo

*Attorney, Agent, or Firm*—Joseph E. Gerber

[57] ABSTRACT

The golf tee mat of the present invention comprises a sliding pad mounted in and surrounded by a U-shaped stance pad. Said stance pad accommodates a practicing golfer's planted feet and comprises a stiff, slippery, base sheet overlain and partially covered by a U-shaped, artificial turf-covered support layer. The sliding pad has a stiff, flexible, slippery base overlain with a resilient cushion and a layer of artificial turf; it nests resiliently in the space left uncovered between the arms of the U-shaped support layer. The sliding pad is in tongue and groove relation with the stance pad over short length near its exposed end, the rest of the stance pad's length being free to propagate a wave ahead of a swinging golf club's head to simulate the feel of taking a divot.

The mat further includes a cavity containing a mass of pliable matter, such as clay or putty, into which a tee may be inserted for practicing drives with wood clubs.

12 Claims, 2 Drawing Sheets

FIG.-1
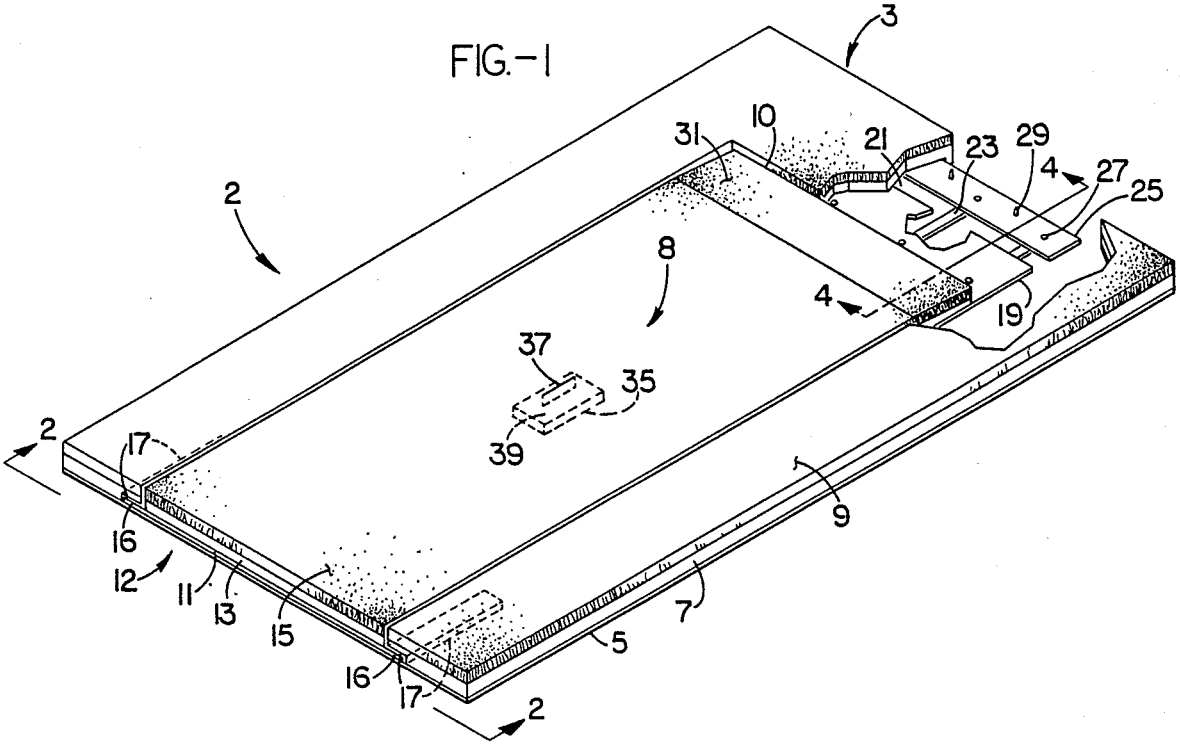
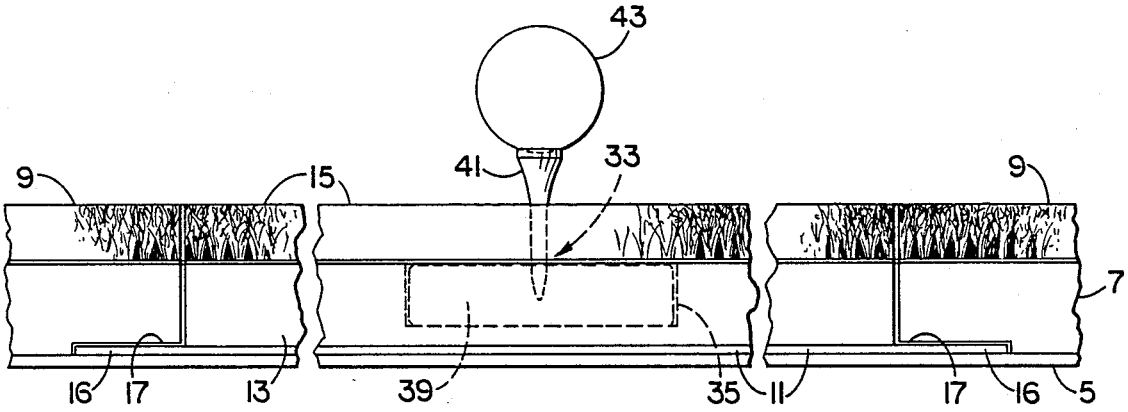
FIG.-2

HORIZONTALLY-RESILIENT GOLF TEE MAT

BACKGROUND OF THE INVENTION

1. Field of the Invention

The invention relates to mats upon which golfers may execute practice shots simulating conventional play, and more particularly to golf mats directed to duplicating the feel of a golf shot on natural turf.

2. Description of the Related Art

The path of a club head during a properly executed golf swing has several components. As it is travelling toward the ball in a downward arc it has both forward-horizontal and downward-vertical moments. At the low point of its arc its motion is purely horizontal. And, of course, beyond that its motion is both horizontal and upward.

Two critical elements are in the path of a club head following this arc, the golf ball and the turf below it. In the great majority of shots, the club head makes contact with the turf as well as the ball. During some of these, the club head contacts the turf and ball simultaneously; other times the turf is contacted first. This all depends upon where the low point of the swing's arc resides.

When using an iron and purposely taking a "divot" the turf is struck after the ball, the low point of the arc in that case being beyond the ball's position and below the turf's surface. After striking the ball the club head is rapidly but smoothly decelerated as it digs into the turf. Then, for some time after reaching the low point of its arc, the club head travels upward through the turf as it scoops out and accelerates the divot. This practice of "hitting down on the ball" and taking a divot is useful in that it gives the ball backspin, enabling the golfer to better control the ball's flight as well as its roll after hitting the ground.

When executing a swing upon a practice mat it is desirable that the mat provide a realistic, natural-turf feel with respect to all the aforementioned components of the swing's arc. This is especially true when practicing divot-taking shots. That is, cushioning should be provided for the downward-vertical moment, resistance against the horizontal moment should be present, and the feel of taking and accelerating a divot in an upward, forward direction should be simulated.

Numerous devices have been developed to simulate the feel of a natural turf execution of a practice golf swing. The simplest type of golf practice mat is a stationary one, having an upper surface of artificial grass such as Astro Turf. Such stationary mats do not simulate an actual fairway shot because they fail to provide the combination of cushioning, resistance and yielding one feels when golfing on natural turf.

Attempts have been made to simulate the actual feel of fairway, divot-taking shots by utilizing practice mats which are moveable in the direction of golf ball travel. These moveable mats also show a reduced susceptibility to wear in the areas where the club head frequently contacts the mat's surface. One such device is that shown in U.S. Pat. No. 3,712,628 issued to Boss in 1973. Boss discloses a continuous belt of artificial turf from which a golf ball may be driven. However, Boss fails to include means for providing realistic resistance against the horizontal component of a swing, the belt and rollers of his device being designed instead to minimize resistance against the club head. Further, the number of moving parts Boss uses would seem to make his device fairly expensive and more prone to failure. It is also apparent that the Boss device could not accommodate those seeking to practice alternative shots, such as those requiring a "golf tee."

Another such device is shown in U.S. Pat. No. 4,311,312 issued to O'Brien in 1982. That device comprises a pad of artificial grass which is slidably mounted within a rectilinear frame, and has resilient means connecting the front and rear ends of the pad to the frame. The frame is positioned adjacent a stance pad. In O'Brien's 1982 patent the artificial grass rests on and slides directly on a rigid, stationary base mat. Thus, while O'Brien claims that this structure results in a realistic feel of taking a divot on a fairway, it would seem that the club head would be brought to an abrupt and unnatural stop after it inevitably hits the rigid base underlying the artificial turf. That is, adequate cushioning of the vertical component of the swing does not seem to be provided. Further, said mat would tend to collect sand and dirt within its closed frame, thereby inhibiting its reciprocating action. Finally, the 1982 O'Brien device employs a sliding pad having an exposed turf edge at its trailing end upon which the head of a golf club may easily catch thereby seriously interrupting a golfer's swing.

U.S. Pat. No. 4,387,896 resulted from a continuation-in-part of O'Brien's 1982 patent and was issued in 1983. This latter patent shows a variation of the device claimed in its parent patent; herein the slidable pad of artificial grass slides on a slippery surface. Side rails and end rails border the slidable pad, said rails having recesses shaped to receive the pad's outwardly-projecting tongues, these restricting its motion to the horizontal plane. The tongues form the backing or base of the artificial grass pad. No resilient means are used in this device; its structure is said to permit the entire slidable mat to move forward in a horizontal plane when the golf club hits the ball.

This structure would be subject to the same inability to clear itself of dirt, and likelihood of catching club heads on its trailing edge, as the device of O'Brien's 1982 patent. Further, its horizontally-projecting tongues as received by the rails, recesses serve to restrict the pad strictly to horizontal movement. This fails to accommodate the upward vertical component of a swing as it normally exists when a divot is being lifted out of the surrounding turf. That is, O'Brien's tongues prevent any lifting up of the slidable pad because their length is bound under the side rails.

Finally, O'Brien's failure to provide resilient means in the device of his 1983 patent requires that the pad be repositioned after each swing and ignores the value of said means in finely tuning the feel of the mat's resistance against a swinging club head.

Lindquist, in U.S Pat. No. 4,130,283 issued in 1978, discloses a golf practice device including a planar, U-shaped stationary section with a sled which is moveable within the U and held in the retracted position by a spring or other resilient means. The entire device is overlain with artificial turf which is cushioned by a layer of foam rubber. In both the stationary and moveable parts of the device, the foam rubber is mounted inside a frame which, in turn, is mounted on a rigid base. The sled has "Teflon" rails on its underside which slide on mating rails of the same material on the base. The sled also has tongues along its entire length on each side, the tongues engaging mating grooves or slots in the adjacent stationary frame.

Lindquist's device is impractical in view of its complexity and probable expense of constructing its frame. Further, being rigid, its frame would be subject to breakage, making the mat's entire structure vulnerable. In addition, uniform support is not provided beneath the artificial turf surface of his mat; cushion underlies some areas, others are supported by frame members, and still others have no support at all. Most notably, the projecting tongues along the sled's entire length, and the mating grooves along the entire length of the U's interior, prevent the sled's upward movement and interfere with the action necessary to approximate the feel of taking a divot. And, the trailing edge of Lindquist's sled is so constructed as to permit golf clubs to catch on it and tear the artificial turf layer loose.

Even though mats with moveable pads are particularly suited for practicing shots with irons, one may also desire to practice drives with woods from said same mats. Although the feel of cushioned turf is not as crucial in that case, the desirable sensation of yielding and the advantage of reduced wear to the mat's surface may nevertheless be realized. To facilitate driving practice, inclusion of means for accommodating a golf tee is necessary. However, Lindquist's device is the only one of the aforementioned mats including such means. Lindquist provides a vertically-extending opening in the upper foam surface of his mat for this purpose. However, this opening would seem prone to rapid wear and likely to clog with broken tee stems.

In my earlier U.S. Pat. No. 4,596,392 issued in 1986, I disclose a clayey deposit for supporting a golf tee, although this is in the context of a stationary mat. Further, said deposit remains exposed during use and therefore tends to be fairly rapidly depleted.

In sum, none of the foregoing devices provides a durable, simply-constructed, wear-resistant practice golf mat able to simulate the feel of a shot, especially a divot-taking shot, from natural turf.

SUMMARY OF THE INVENTION

The golf practice device of this invention is directed to solving the aforementioned difficulties. It comprises a hitting surface formed as a sliding pad mounted in and surrounded by a U-shaped stance pad, said stance pad accommodating a practicing golfer's planted feet.

The sliding pad has a stiff, yet flexible, slippery base overlain with a resilient layer of cushion covered, in turn, with artificial turf. The stance pad employs a stiff, slippery, rectangular base sheet overlain and partially covered by a U-shaped, artificial turf-covered support layer of, at least, moderate stiffness and density. Thus, a portion of the underlying base between the U-shaped support layer's arms remains uncovered. The sliding pad is resiliently mounted for retraction into the space between said arms and slides on the uncovered portion of the stance pad's underlying base.

The exposed or distal end of the sliding pad has a pair of outward-projecting tongues adapted to mate with parallel opposing grooves in the U-shaped support pad's arms. These tongues run along no more than about a third of the length of the sliding pad, the remaining length of this pad being free to be lifted out of the stance pad by the impact of a golf club.

The sliding pad is further adapted to improve over the prior art in that it has reduced thickness toward its nested end, that is, its end most proximal to the apex of the area between the arms of the support layer. This reduced thickness decreases the likelihood of snagging a club head on the sliding pad.

And, despite this inventive golf mat's particular utility for executing natural-feeling shots with iron clubs, unobtrusive means for accommodating a tee for wood shots is also included. This comprises a slit in the turf layer of the sliding pad underlain by a deposit of pliable matter retained in a cavity in the pad's resilient layer.

Thus, it is an object of the present invention to provide a golf practice mat able to simulate the feel of natural turf when swinging with an iron club, and especially when taking a divot.

It is a further object of this invention to provide a golf practice mat having a moveable hitting surface able to yield in a forward, upward direction, much as a divot does when leaving its surrounding turf.

It is another object of this invention to provide a practice mat with a moveable hitting surface able to yield in a forward, upward direction without becoming disengaged from its surrounding stance pad.

Yet another object of the present invention is to provide a practice mat having a moveable hitting surface, the mechanism of which is not susceptible to fouling by the dirt and sand that loads up in such mats when used at driving ranges and the like, the mechanism of this mat being self-cleaning.

Still a further object of this invention is to provide a practice mat with a moveable surface within a surrounding stance pad, having means for protecting the edge of said moveable surface from being snagged by the head of a swinging club.

And, an additional object of the invention is to provide a mat particularly adapted to practicing iron shots that nevertheless has convenient and unobtrusive means for retaining a golf tee therein for practicing shots with woods.

It is just as much an object of this invention to provide a golf practice mat with a moveable surface being, at once, strong and durable, simple in design and economical to produce.

Other objects of this invention will be evident from the drawings and their following brief description, as well as from the detailed description of the preferred embodiment.

BRIEF DESCRIPTION OF THE DRAWINGS

FIG. 1 is a perspective view of the golf practice mat of the present invention showing, in cut-away, the resilient means for keeping the sliding pad retracted within the U-shaped stance pad.

FIG. 2 is an elevation of the practice mat viewed along line 2—2 of FIG. 1, and showing, in phantom, golf tee mounting means beneath the sliding pad's surface.

DETAILED DESCRIPTION OF THE PREFERRED EMBODIMENT

Figure 3:
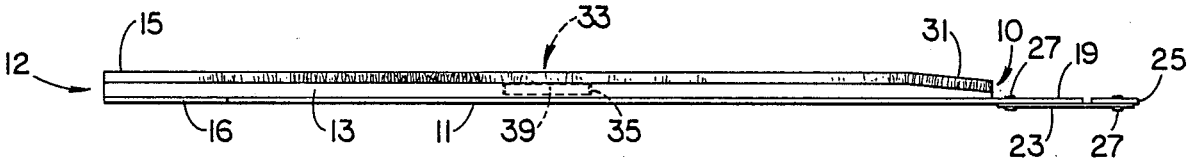
FIG. 3 is a side elevation of the sliding pad and its resilient means removed from their position within the U-shaped stance pad.

FIG. 1 shows the preferred embodiment of the golf practice mat of the present invention, generally referred to by reference numeral 2. Therein, a stance pad 3 comprises a substantially rectangular base 5 of tough, slippery sheet material. High-density, cross-linked polyethylene sheets approximately 3 mm in thickness have been found to work well in this capacity, although, other low-friction plastics, and the like, such as "ABS" or "Teflon" may also work well.

Bonded to base 5 is a U-shaped support layer 7 which bears the weight of the practicing golfer. Hard rubber approximately 1 cm thick functions well here, although materials running the full spectrum of rigidity from resilient, moderately dense, closed-cell foam to rigid plywood have advantages for different applications. For example, foam gives the most realistic underfoot feel, while plywood is most durable. Further limitations upon the nature of this material are discussed in light of additional cooperating elements, below.

A layer of artificial turf 9 such as "Astro Turf" is overlaid and bonded to support layer 7. Turf layer 9 has the same shape and dimensions as support layer 7. This leaves an uncovered area of base layer 5 between the arms of the two U-shaped layers of stance pad 3.

An elongate sliding pad 8 which acts as a golf ball hitting surface fills the space between the arms of the U-shaped support layer 7 and its turf covering 9. Pad 8 has a nested, proximal end 10 with respect to the apex of the space between the arms of the U, and an exposed, distal end 12 with respect to same. Pad 8 comprises a base layer 11 which is preferably of the same material as base layer 5 of the stance pad. Over this resides an intermediate resilient layer 13, this being covered with a top layer of artificial turf 15. Resilient layer 13 has been found to have the most realistic feel in cushioning the downward component of a golf club's arc when it is constructed of moderately-dense, closed-cell, polyurethane foam.

Good results have been achieved using a base 11 of approximately 2 mm in thickness and a resilient layer 13 approximately 1 cm thick.

Sliding pad 8 preferably has an overall thickness sufficient to make its turf surface 15 level with turf 9 of stance pad 3 when it resides in the space between the arms of the U of the stance pad. The thickness of either support layer 7 or resilient layer 13 are conveniently adjusted to achieve this optimum.

Sliding pad 8 has a width, in general, just slightly less than the width between the arms of the U-shaped layers of stance pad 3. This allows sliding pad 8 to fit snugly between said arms. Base layer 11 of sliding pad 8 rests and moves on the uncovered area of base layer 5 between the arms of stance pad 3's U.

Overall, the dimensions of sliding pad 8 must be tuned to the materials used to give it the proper mass, and therefore the proper resistance against a club head, to yield a natural swingfeel. It is also important to match the thickness and flexibility of the materials used with the overall dimensions of the pad to assure that it is sufficiently limber to have the desired unique wave action described more fully blow. Using the materials discussed above, good results have been recorded using a sliding pad having resilient and turf layers, 13 and 15 respectively, of 75 cm in length and 32 cm in width. However, it appears that narrower pads 8 may, due to increased flexibility, yield more dramatic wave motion and consequently a more natural swing-feel.

Stance pad base layer 5, support layer 7 and turf layer 9 may be bound together with any conventional means; a glue layer therebetween (not shown) is expedient. Sliding pad base layer 11, resilient layer 13 and turf layer 15 may be similarly bound.

Base layer 11 includes a pair of laterally-extending tongues 16 at its exposed end 12. Tongues 16 engage mating grooves 17 which are defined by parallel strips of reduced thickness along the inside edges of the arms of U-shaped support layer 7. Grooves 17 are further defined by the adjacent upper surface of base layer 5. This tongue and groove arrangement is best seen in FIG. 2. Tongues 16 extend a short distance along the sliding pad from its exposed end 12 toward its nested end 10, as best seen in phantom in FIG. 1 and in side elevation in FIG. 3. And, grooves 17 extend a sufficient enough distance to accommodate tongues 16 when sliding pad 8 is fully nested within the space between the arms of the U of stance pad 3.

For best results in practicing the invention, tongues 16 should probably not be much longer than about a third of the length of sliding pad 8. Naturally, grooves 17 need only be of a corresponding length.

The proper function of grooves 17 in guiding tongues 16 puts a limit on one end of the spectrum of materials usable in support layer 7 of stance pad 3. Although the softer closed-cell foams give a more natural under-foot feel, some may be too soft to form a durable groove in which tongues 16 may travel. Thus, since frame members are sought to be avoided herein, support layer 7 must, minimally, be of a material within the edge of which a durable groove may be cut. Plywood obviously fills this requirement. However, the hard rubber and denser foams tried also give satisfactory results, an additional benefit of such materials being their ability to withstand considerable flexing during transport or storage without later loss of precision action. This flexibility also permits such mats to be used on uneven surfaces with unimpeded function.

Figure 4:
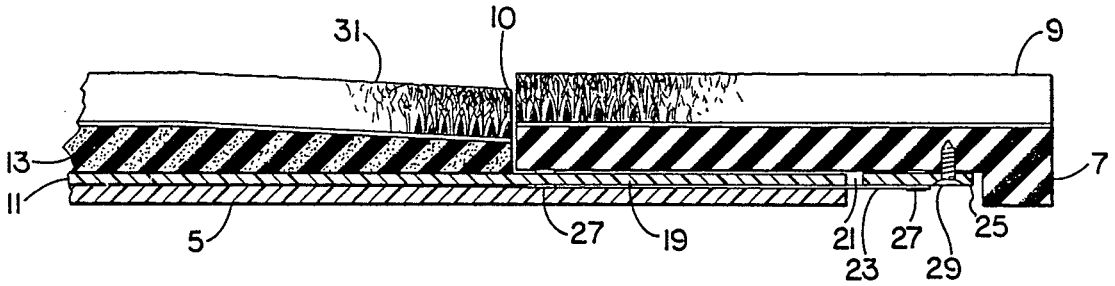
FIG. 4 is a sectional view of the device of FIG. 1 taken along lines 4—4 thereof.

Base layer 11 is preferably somewhat longer than the upper layers, 13 and 15, of pad 8. Thus, an extension, 19, trails behind pad 8. Extension 19 is received in a recess, 21, under support layer 7 when pad 8 is fully nested within stance pad 3. This is best illustrated in FIG. 4. Recess 21 is approximately as wide as sliding pad 8.

As shown in cut-away in FIG. 1 and in cross-section in FIG. 4, pad 8 is bound for resilient retraction into the space between the arms of stance pad 3's U. The preferred resilient means employs one or more elongate elastic members 23 bound between the nested end, conveniently extension 19, of pad 8 and an anchor bar, 25, fixed in recess 21. Four 8 mm elastic fabric strips have worked well as resilient means, fasteners such as rivets 27 or equivalent fastening means being preferred for fixing said strips to extension 19 and anchor bar 25. It is further preferred that anchor bar 25 be removeably fixed in recess 21 with screws 29, or the like. If as in FIG. 4 base layer 5 is cut shorter in length than support layer 7, access to screws 29 is preserved. Thus, sliding pad 8 may be easily replaced with another after simply unscrewing the anchor bar. In this manner, new sliding pads or pads with different textured surfaces may be interchanged with little effort. To protect anchor bar 25 and its resilient means against abrasion from beneath, an additional panel (not shown) may be provided thereover, spanning the gap shown in FIG. 4 between the edge of base layer 5 and the nether face of support layer 7 beyond the anchor bar.

The relative retracting force of said resilient means may be adjusted by changing the strength or number of the elastic members to yield the most realistic feel to the practicing golfer. Consideration should be given to the mass of the particular sliding mat used when making this adjustment. The strength of said means will, also affect the length needed in tongues 16. Said tongues need only be long enough to hold pad 8 in place during its furthest likely excursion from its nested position.

As shown in FIGS. 1, 3 and 4, the nested end 10 of pad 8 slopes downward toward the point where it butts up against stance pad 3. This slope, 31, preferably begins behind the area from which the golf ball is hit. This design makes the turf surface at the nested end 10 of the sliding pad 8 slightly lower than the adjacent surface of the stance pad 3, as best illustrated in FIG. 4. Slope 31 reduces the likelihood of the nested end of pad 8 being snagged by the head of a misdirected swinging golf club. This slope is best achieved by gradually decreasing the thickness of pad 8's resilient layer 13 toward the nested end of said pad.

Approximately in the center of sliding pad 8 is a concealed golf tee receiving means, 33. As seen in FIGS. 1, 2, and 3, a cutout 35 is provided in resilient layer 13 directly beneath a slit 37 in overlying turf layer 15. Cutout 35 is substantially filled with a deposit of pliable matter 39 such as a non-drying, oil-based clay or putty. Pliable deposit 39 is preferably of stiff enough texture to support a golf tee 41 and ball 43, as in FIG. 2, for a practice golf shot with a wood, or driver. The concealed design of tee receiving means 33 retards depletion of the pliable matter in deposit 39 and keeps the tee receiving means, as a whole, from interfering with divot-taking shots, and the like.

In use, a golfer places practice mat 2 upon a generally level surface and places a golf ball near the center of pad 8. The golfer then approaches the ball in the conventional manner and executes a swing. In the case of a shot where a divot would not normally be taken, pad 8 merely yields in the direction of travel of the club head 45. This avoids a great deal of the wear that normally necessitates frequent replacement of conventional mats. As club head 45 further follows its arc, contact with pad 8 is lost permitting its resilient retraction into its nested position. Thereby, it is readied for another practice swing.

Figure 5:
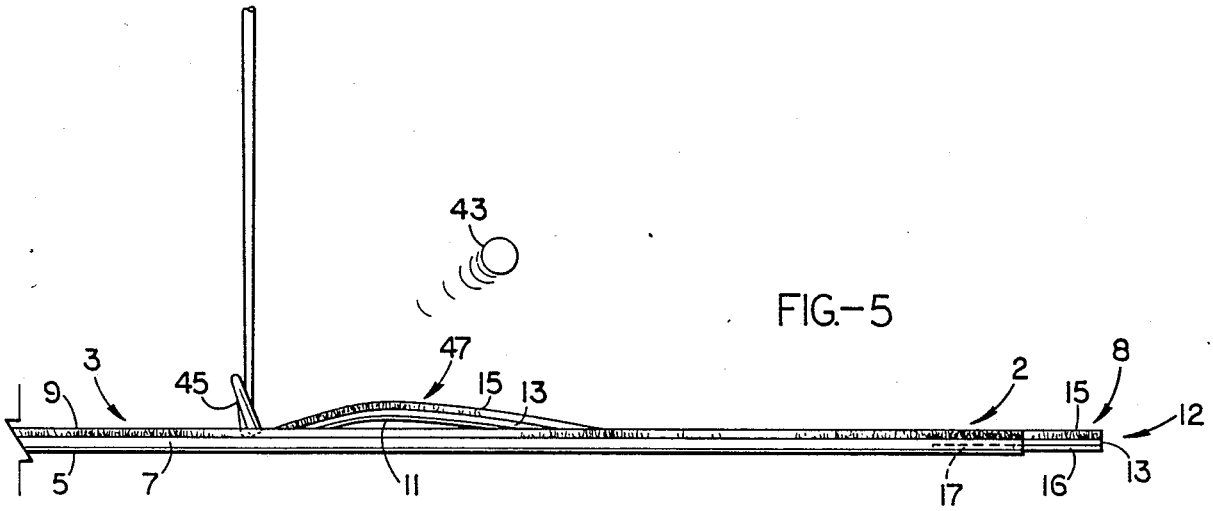
FIG. 5 is a side elevational view from opposite a practicing golfer showing a wave propagated in the sliding pad by the golfer's club while practicing a divot-taking shot.

If the golfer wishes to simulate a divot-taking shot, the club head will strike the ball before the lowest point of the club head's arc is reached. After striking the ball, the club head digs into pad 8's cushion and pushes pad 8 rapidly forward. Pad 8, being so rapidly accelerated, tends to buckle upward before moving forward. Thus, as shown in FIG. 5, a wave 47 is propagated ahead of the club head as it moves forward along its arc. This wave ahead of the club head simulates the feel of a divot being torn loose from natural turf because it rises in height ahead of the club head and decelerates it for an instant. Wave 47 rides in front of the club head momentarily as the resilient means of pad 8 extend. As the club head starts to arc slightly upward, wave 47 continues to build in height ahead of the club head. As the club head rises further from the turf, it starts to lose its frictional grip on the wave. As the same time, due to its stiff, yet flexible, slippery base 11, pad 8 snaps back into its preferred planar configuration, the resistance of the wave then being removed from in front of the club head. This action closely simulates the feel of a natural divot flying away from the club head in a straight line after being torn loose from the turf and carried momentarily in front of the club head. Video tapes of the aforedescribed action, viewed in slow motion, confirm the propagation of wave 47 ahead of club head 45.

At the end of the swing, proper nesting of pad 8 between the arms of the stance pad's U is assured because tongues 16 keep the exposed end of pad 8 horizontal and unaffected by wave 47. And, even though two-thirds, or so, of the pad's length is free to rise in the form of a wave, extension 19 trails behind, its upward movement being restricted by recess 21 thereby assuring proper nesting of pad 8.

Use of mat 2 with a wood club for driving practice is accomplished by planting a golf tee 41 upright in the pliable deposit 39 of tee receiving means 33. The ball is placed atop the tee and played as usual, pad 8 yielding in the direction of club head travel thereby reducing wear to the surface.

Practice mat 2 is expected to be used on driving ranges, and in like environments where practicing golfers track dirt and sand onto the mat with their spikes. Due to the unique design of mat 2, with its sliding pad base 11 repeatedly traveling over stance pad base 5, a self-cleaning function results. That is, sand and dirt between the sliding layers is kicked out under the exposed end 12 of pad 8 with each cycle. This helps assure a long service life of the mat.

The foregoing detailed disclosure of the inventive practice golf mat is considered as only illustrative of the preferred embodiment of, and not a limitation upon the scope of, the invention. Those skilled in the art will envision many other possible variations of the structure disclosed herein that nevertheless fall within the scope of the following claims. And, alternative uses for this mat may later be realized. Accordingly, the scope of the invention should be determined with reference to the appended claims, and not by the examples which have herein been given.

What is claimed is:

1. A golf swing practice mat comprising:

a. a stance pad including a rectilinear base layer of tough, slippery sheet material with a U-shaped support layer of, at least, moderate stiffness and density covering all of said base layer but the area between the arms of said U, said U-shaped layer being covered with a layer of artificial turf of like size and shape;

b. a pair of parallel opposing grooves in said stance pad along the inside edges of the arms of said U-shaped support layer;

c. a sliding pad mounted between the arms of said U-shaped support layer having exposed and nested ends, comprising artificial turf level with said stance pad's turf and overlying a resilient layer, said resilient layer being, in turn, underlain by a base layer of tough, flexible, slippery sheet material;

d. resilient means connected to the nested end of said sliding pad for holding said sliding pad retracted within said stance pad;

e. a pair of tongues toward the exposed end of said sliding pad's base layer which engage said stance pad's parallel opposing grooves, said tongues extending along no more than about a third of said sliding pad's length, whereby said sliding pad is free to be lifted out of said stance pad by the impact of a golf club head over a majority of its length;

2. The golf swing practice pad of claim 1 wherein said sliding pad's resilient layer is slopingly reduced in thickness toward its nested end.

3. The golf swing practice pad of claim 1 wherein said sliding pad includes golf tee mounting means near its center comprising a slit in its turf layer and a cutout in its resilient layer thereunder, said cutout being filled with a pliable deposit for supporting a golf tee.

4. The golf swing practice pad of claim 1 wherein said stance s support layer comprises resilient material.

5. The golf swing practice pad of claim 1 wherein said stance pad's support layer comprises rigid material.

6. The golf swing practice pad of claim 1 wherein said sliding pad's resilient layer comprises closed-cell foam.

7. The golf swing practice pad of claim 1 wherein said resilient means comprises at least one elongated elastic member bound between said sliding pad's nested end and a bar able to be removeably fixed into a recess in the underside of said support layer adjacent the apex of its U.

8. A golf practice device comprising a sliding pad which serves as a golf ball hitting surface, said sliding pad being mounted for sliding motion within a generally planar, U-shaped stance pad having an upper surface even with said hitting surface, said sliding pad being resiliently biased for nesting within said U and having a first end proximal to the apex of said U and a second distal end having a pair of tongues no longer than about a third of the length of said sliding pad which engage mating grooves in the adjacent portion of the stance pad.

9. The device of claim 8 wherein said sliding pad comprises a base layer of flexible, slippery sheet material with said tongues forming integral parts of said base layer, an intermediate layer of closed-cell foam and an upper layer of artificial turf.

10. The device of claim 8 wherein said proximal first end of said sliding pad slopes downwardly below the level of the adjacent portion of said stance pad.

11. The device of claim 8 wherein said sliding pad includes golf tee receiving means located between its proximal and distal ends, said receiving means being recessed beneath said pad's upper layer of turf.

12. The device of claim 11 wherein said tee receiving means comprises a mass of pliable matter within a cavity in said foam layer under a slit in said overlying turf layer.

* * * * *